US006175090B1

(12) United States Patent
Blossfeld

(10) Patent No.: US 6,175,090 B1
(45) Date of Patent: Jan. 16, 2001

(54) ROCKER SWITCH

(75) Inventor: Michael Blossfeld, Pinckney, MI (US)

(73) Assignee: TRW Inc., Lyndhurst, OH (US)

( * ) Notice: Under 35 U.S.C. 154(b), the term of this patent shall be extended for 0 days.

(21) Appl. No.: 09/389,180

(22) Filed: Sep. 2, 1999

(51) Int. Cl.[7] ..... H01H 21/82
(52) U.S. Cl. ..... 200/558; 200/401
(58) Field of Search ..... 200/558, 553, 200/557, 401, 438, 408, 499, 531, 536, 541, 550, 563, 571, 552

(56) References Cited

U.S. PATENT DOCUMENTS

| | | |
|---|---|---|
| 3,670,121 | 6/1972 | Howe . |
| 4,967,046 | 10/1990 | Priesemuth . |
| 5,149,924 | 9/1992 | Priesemuth . |
| 5,598,918 | 2/1997 | Malecke et al. . |
| 5,833,048 | 11/1998 | Dilly . |

*Primary Examiner*—Michael L. Gellner
*Assistant Examiner*—Nhung Nguyen
(74) *Attorney, Agent, or Firm*—Tarolli, Sundheim, Covell, Tummino & Szabo L.L.P.

(57) ABSTRACT

An electrical switch (10) includes first and second spaced contacts (52, 56), and a rocking contact (80) having first and second arms (90, 92) in electrical contact with each other. A support (60) supports the rocking contact (80) for rocking movement in opposite first and second directions. The first arm (90) moves into engagement with the first contact (52) when the rocking contact (80) rocks in the first direction, and the second arm (92) moves into engagement with the second contact (56) when the rocking contact (80) rocks in the second direction. The switch (10) includes a member (20, 36) which pivots to effect rocking movement of the rocking contact (80) in the first and second directions. The member (20, 36) pivots in one direction a first distance to cause the first arm (90) to engage the first contact (52) and pivots in the one direction a second distance beyond the first distance to cause the first arm to slide on the first contact.

13 Claims, 4 Drawing Sheets

ROCKER SWITCH

BACKGROUND OF THE INVENTION

1. Technical Field

The present invention relates to an electrical switch.

2. Description of the Prior Art

Vehicles with electric power devices, such as windows, typically have a control system with several individual switches. Each switch has a manually engageable lever pivotable to actuate the device.

One known window switch structure is described in U.S. Pat. No. 5,598,918. The switch includes an actuator which is manually pivotable in opposite directions to engage and close electrical contacts for energizing the motor. The switch also includes an electrical contact which is rocked by the pivoting actuator to close a set of contacts in the switch. The electrical contact is made from metal.

SUMMARY OF THE INVENTION

The present invention is an electrical switch comprising spaced first and second contacts, and a rocking contact having first and second arms in electrical contact with each other. A support supports the rocking contact for rocking movement in opposite first and second directions. The first arm moves into engagement with the first contact when the rocking conactrocks in the first direction, and the second arm moves into engagement with the second contact when the rocking contact rocks in the second direction. The switch includes a member which pivots to effect rocking movement of the rocking contact in the first and second directions. The member pivots in one direction a first distance to cause the first arm to engage the first contact and pivots in the one direction a second distance beyond the first distance to cause the first arm to slide on the first contact.

BRIEF DESCRIPTION OF THE DRAWINGS

Further features and advantages of the present invention will become apparent to those skilled in the art to which the present invention relates upon reading the following description of the invention with reference to the accompanying drawings, in which.

DESCRIPTION OF A PREFERRED EMBODIMENT OF THE INVENTION

The present invention relates to an electrical switch for controlling a device on a vehicle. The device may be any device on a vehicle, such as a window, a seat, a mirror, or the like. The specific embodiment of the invention described below relates to a power window. It should be understood that the switch of the present invention may control a device other than a window.

Figure 1:
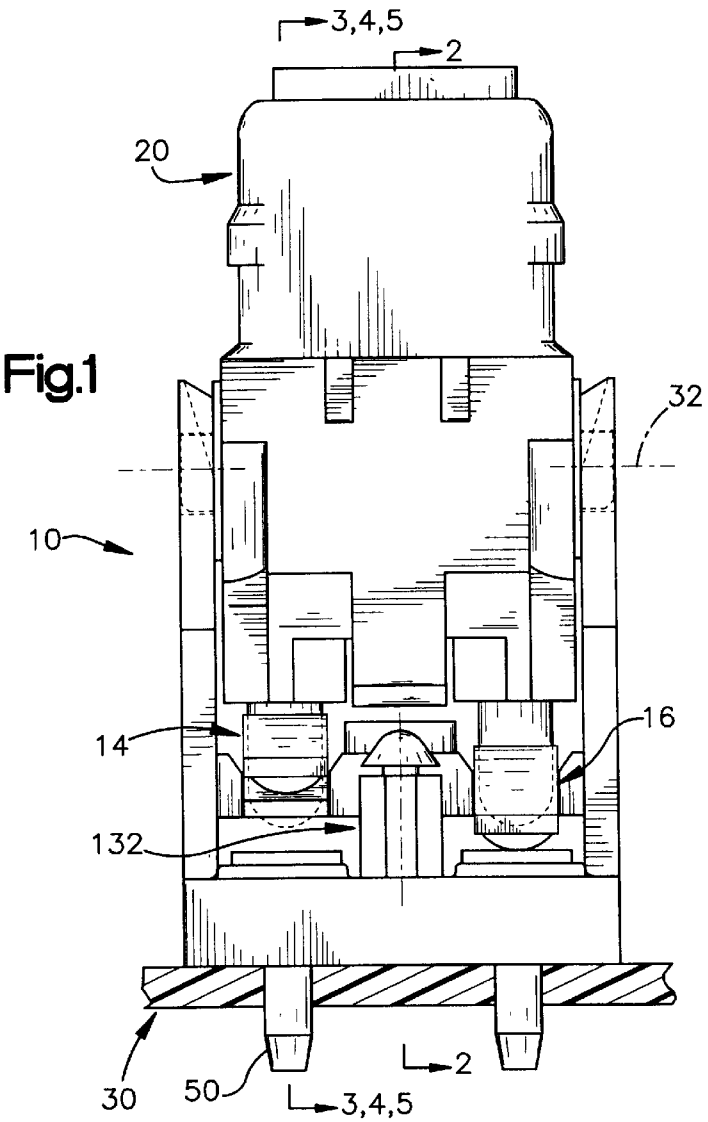
FIG. 1 is a front elevational view of a switch assembly in accordance with the present invention.

The present invention is also applicable to various switch constructions. As representative of the present invention, FIG. 1 illustrates a switch assembly 10. The switch assembly 10 controls operation of an electric motor indicated schematically at 11 (FIGS. 2–5) for raising and lowering a vehicle window (not shown). The electric motor 11 is a DC motor capable of bi-directional rotation.

The switch assembly 10 is generally of the type shown in U.S. Pat. No. 5,598,918, the disclosure of which is herein incorporated by reference. The switch assembly 10 includes a base 12, first and second rocker switches 14 and 16, and a lever 20 for actuating the rocker switches.

The base 12 of the switch assembly 10 is mounted to a printed circuit board 30 or an electrical buss system, not shown. A group of metal switch terminals (described below) protrude from the base 12 of the switch 10 and through corresponding holes in the printed circuit board 30 or electrical buss system to connect the switch assembly with the electric motor 11 for controlling operation of the motor and thereby of the window.

Figure 2:
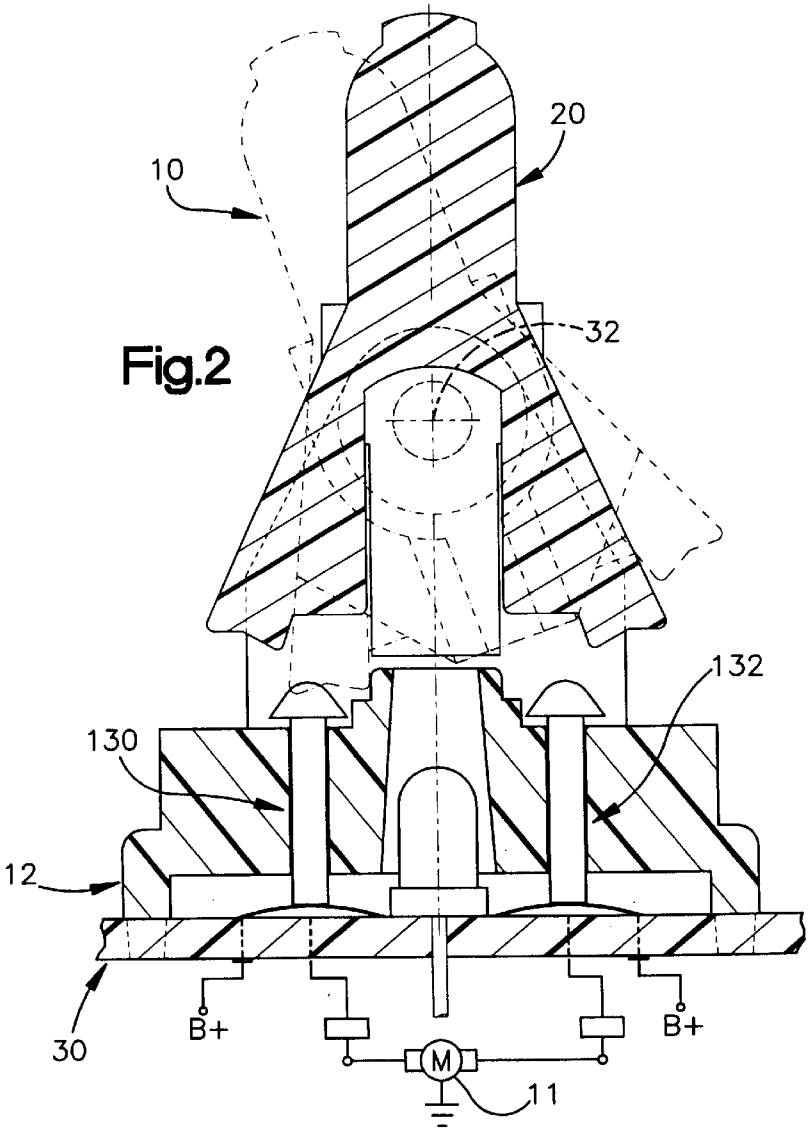
FIG. 2 is a sectional taken along line 2—2 in FIG. 1.
Figure 4:
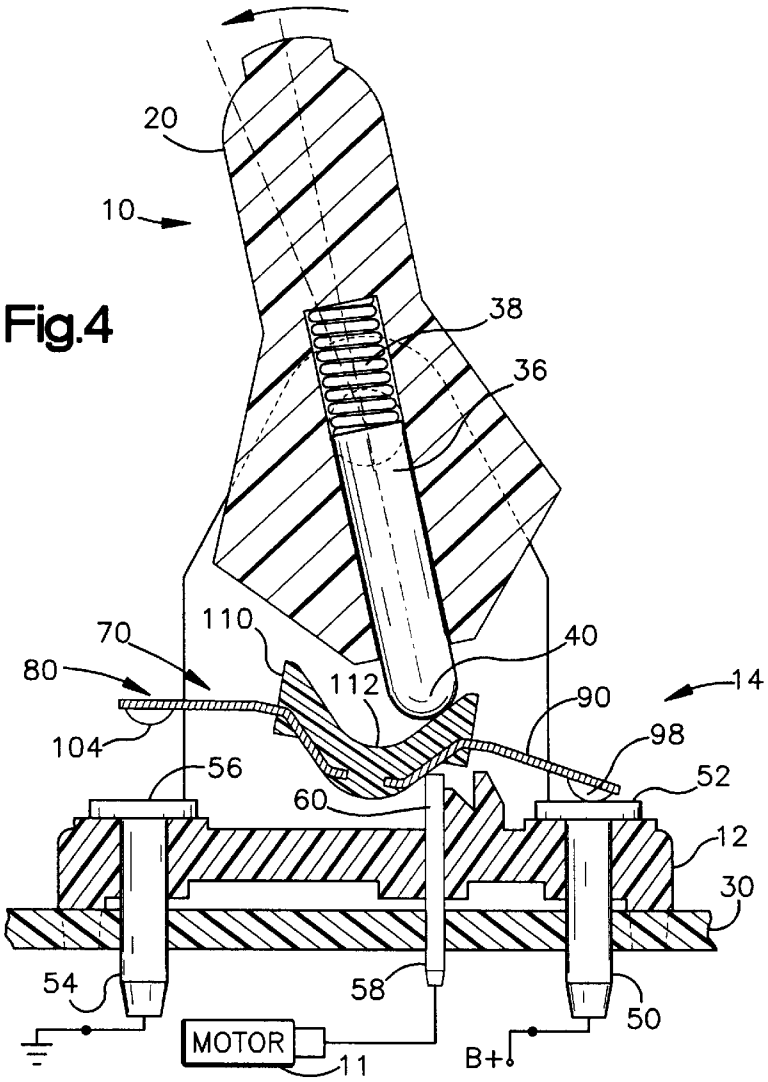
FIG. 4 is a view similar to FIG. 3 illustrating parts of the switch in different positions.
Figure 3:
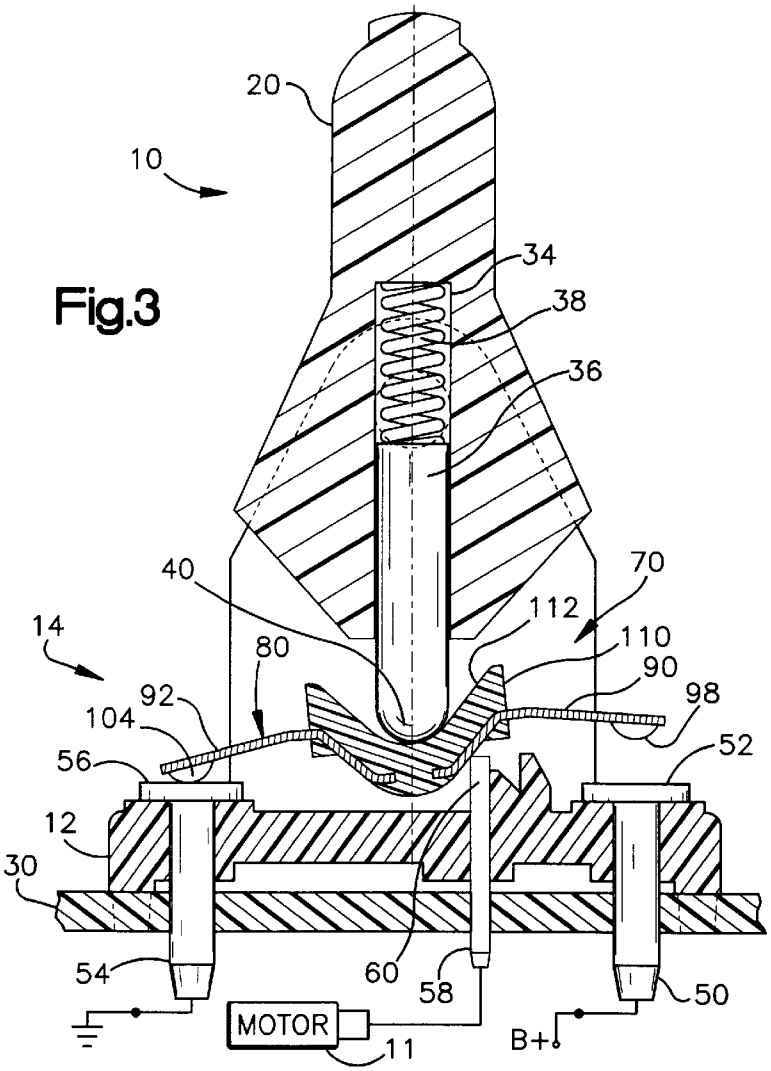
FIG. 3 is a sectional view taken along line 3—3 in FIG. 1.
Figure 5A:
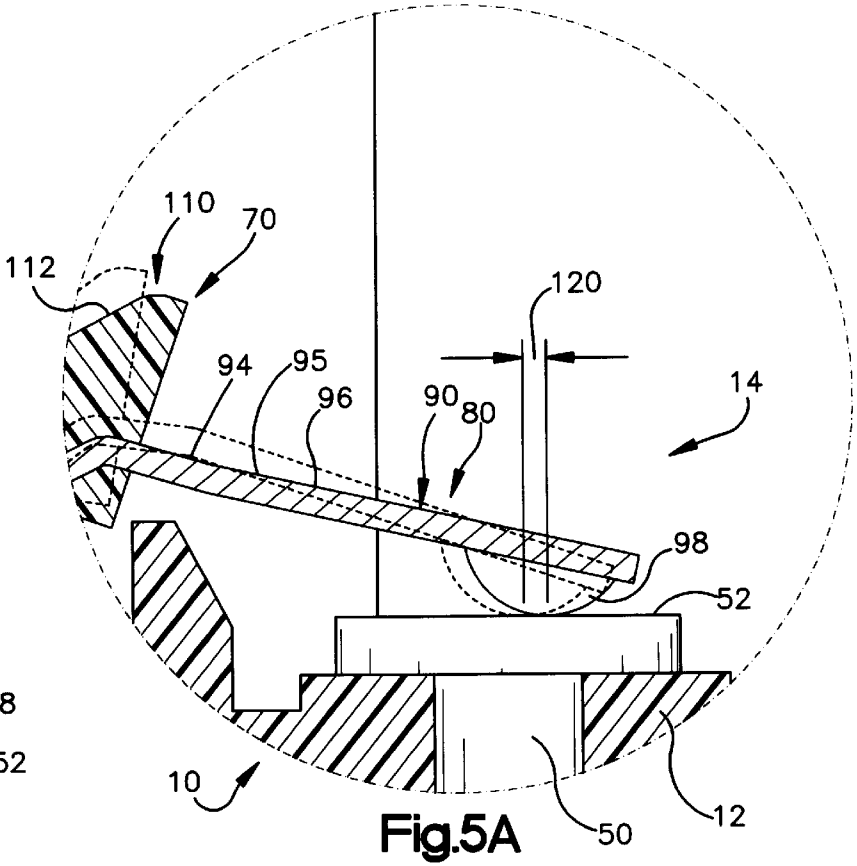
FIG. 5A is an enlarged view of a portion of FIG. 5.
Figure 5:
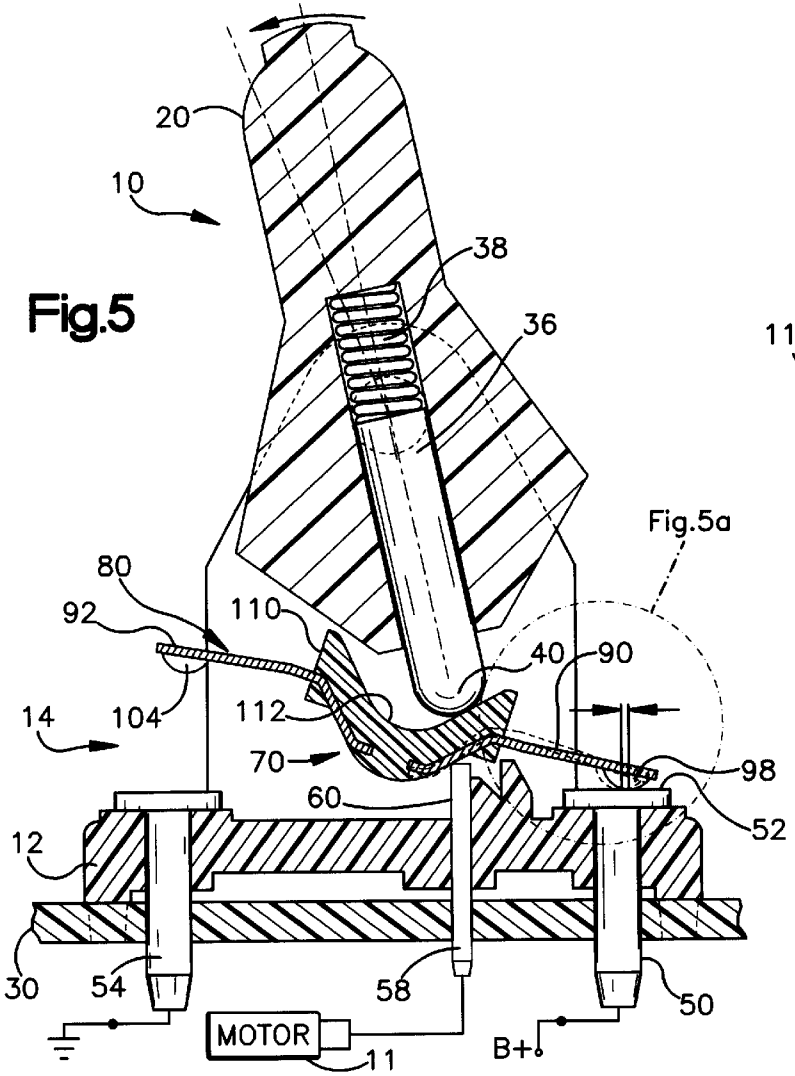
FIG. 5 is a view similar to FIG. 3 illustrating parts of the switch in different positions.
Figure 6:
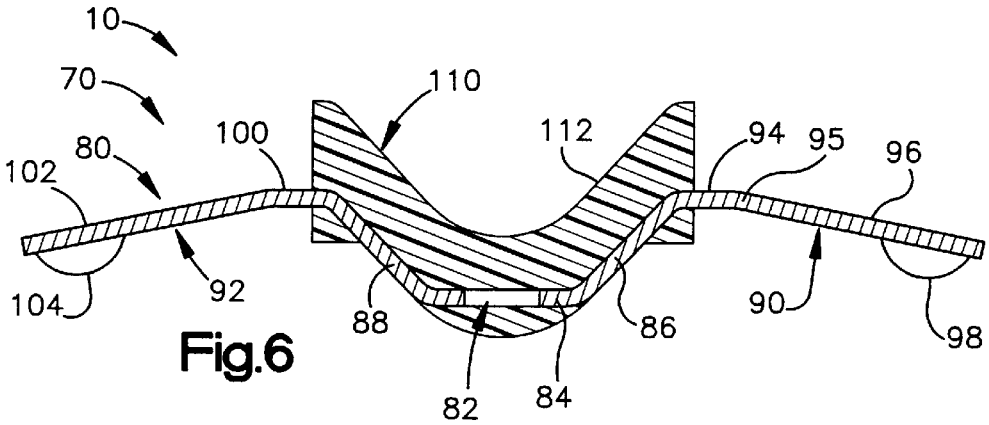
FIGS. 6–8 are a series of views of a rocker contact which is part of the switch assembly of FIG. 1
Figure 7:
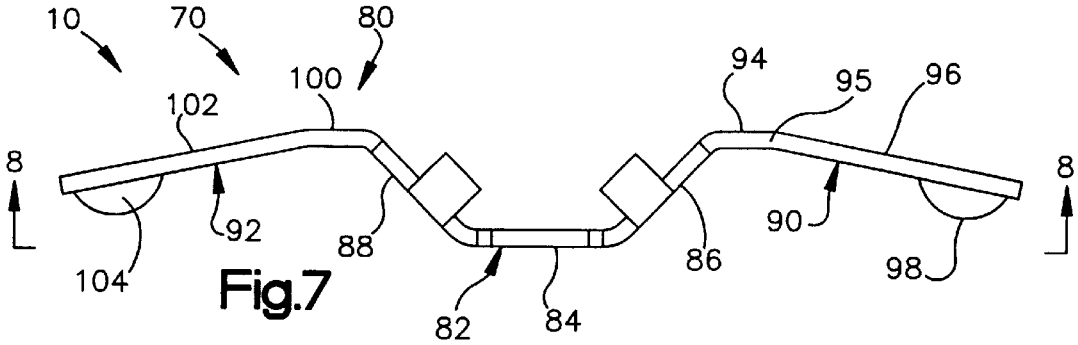
Figure 8:
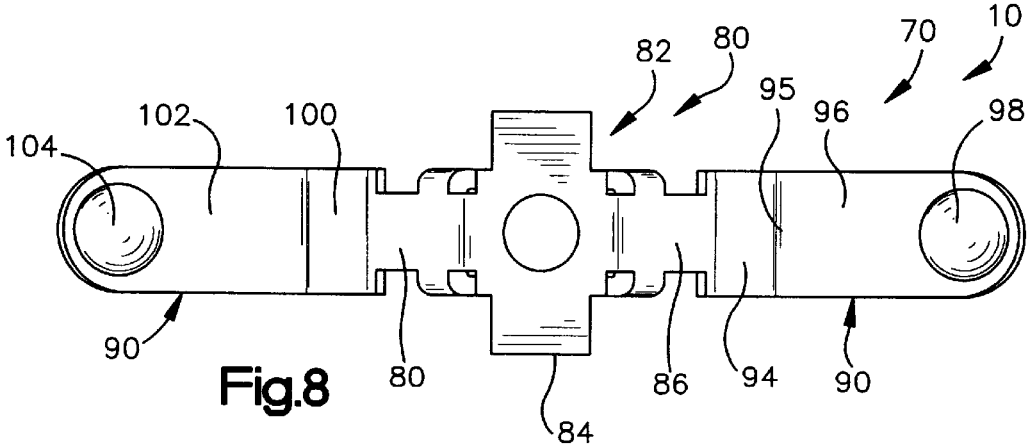

The lever 20 is supported by the base 12 for pivotal movement relative to the base about an axis 32. The lever is biased as described below to a centered or neutral position as illustrated in FIGS. 2 and 3. The lever 20 is pivotable about the axis 32 in opposite directions from the centered position. When the lever 20 is pivoted in a first direction (as shown in FIGS. 4, 5 and 5A) from the centered position, the first rocker switch 14 is actuated to energize the motor to move the window down. When the lever 20 is pivoted in a second, opposite, direction (not shown) from the centered position, the second rocker switch 16 is actuated to energize the motor for rotation in the opposite direction to move the window up. The structure and operation of the first rocker switch 14 are described as exemplary. The structure and operation of the second rocker switch 16 are similar to that of the first rocker switch 14 and therefore are not described.

The lever 20 (FIG. 3) has a cylindrical bore 34 in which are received a pin 36 and a spring 38 for biasing the pin outwardly of the lever. The pin 36 has an outer end surface 40. The outer end surface 40 has a selected, predetermined contour. In the illustrated embodiment, the outer end surface 40 has a spherical or convex contour.

The first rocker switch 14 includes a B+ terminal 50, a ground terminal 54, and a motor terminal 58 that are secured in the base. The B+ terminal 50 is connected to B+ and has a flat upper end surface or first contact 52. The ground terminal 54 is connected to ground and has a flat upper end surface or second contact 56.

The motor terminal 58 is connected to the motor 11. The motor terminal 58 is disposed between the B+ terminal 50 and the ground terminal 54. The first rocker switch 14 includes a moving contact assembly 70. The motor terminal 58 has an upper end portion that serves as a support 60 such as a fulcrum or pivot stand for the moving contact assembly 70.

The moving contact assembly 70 includes an electrical connector or rocking contact 80, made from metal, that is insert molded with a plastic body portion 110 of the moving contact assembly. Alternatively, the contact 80 could be bonded to the body portion 110.

The rocking contact 80 is made from a single piece of resilient, electrically conductive material, preferably metal. A preferred material is a copper alloy having high tensile strength.

The rocking contact 80 has a central portion 82. The central portion 82 has an open U-shape including a base leg 84 and two side legs 86 and 88. The side legs 86 and 88 extend upward and outward from the base leg 84.

The rocking contact 80 has first and second arms 90 and 92 which extend outward from the central portion 82 of the rocking contact. Because the rocking contact 80 is made as one piece from metal, the first and second arms 90 and 92 of the rocking contact are in electrical contact with each other as well as with the central portion 82 of the rocking contact.

The first arm 90 of the rocking contact 80 has a relatively short inner portion 94 which extends from the first side leg 86 in a direction parallel to the base leg 84. A relatively long outer portion 96 of the first arm 90 extends from the inner portion 94, at a slight angle downward from the inner portion. The outer end of the first arm 90 is deformed to form a part-spherical first contact pad at 98. Alternatively, a highly conductive metal formed into a sphere may be the first contact pad 98.

The second arm 92 of the rocking contact 80 has a relatively short inner portion 100 which extends from the second side leg 88 in a direction parallel to the base leg 84. A relatively long outer portion 102 of the second arm 92 extends from the inner portion 100, at a slight angle downward from the inner portion. The material of the second arm 92 is deformed downward to form a part-spherical first second contact pad 104 at the outer end of the second arm. Alternatively, a highly conductive metal formed into a sphere may be the second contact pad 104.

The plastic body portion 110 of the moving contact assembly is molded around the central portion 82 of the rocking contact 80. Alternatively, the plastic body portion 110 could be bonded to the central portion 82. The plastic body 110 has a first surface 112 which has a concave contour. The first surface 112 is presented upward toward the lever 20. Thus, the first surface 112 on the plastic body 110 is presented toward the outer end surface 40 of the pin 36. The metal side leg 86 of the rocking contact 80 is exposed, through the plastic body portion 110, for electrical contact with the pivot stand 60.

The spring biased pin 36 applies a downward force to urge the moving contact assembly 70 downwardly into engagement with the pivot stand 60. The outer end surface 40 on the pin 36 engages the first surface 112 on the plastic body portion 110 of the moving contact assembly 70. The metal side leg 86 of the rocking first contact 80 engages the metal pivot stand 60 to make electrical contact. The pivot stand 60 supports the moving contact assembly 70 for rocking movement in opposite first and second directions, as controlled by the lever 20.

The lever 20 is initially in the centered or neutral position, as illustrated in FIG. 3. When the lever 20 is in the neutral position, the rocker switches 14 and 16 are not actuated and are not providing electrical power to the motor. Specifically, the contact pad 104 of the second arm 92 of the rocking contact 80 engages the ground terminal 54 and as a result the electric motor 11 is not actuated to move the window down. Similarly, the first arm (not shown) of the second rocker switch 16 engages its associated ground terminal and so the motor 11 is not actuated to move the window up.

When the lever 20 is pivoted a first distance to a first actuating position, as illustrated in FIG. 4, the force of the lever is transmitted through the pin 36 into the moving contact assembly 70. The outer end surface 40 of the pin 36 slides along the first surface 112 of the plastic body portion 110 of the moving contact assembly 70. The moving contact assembly 70 rocks about the pivot stand 60, to the position shown in FIG. 4.

In this position, the contact pad 98 on the first arm 90 of the rocking contact 80 engages the contact surface 52 on the B+ terminal 50. This engagement electrically connects the B+ terminal 50 with the motor terminal 58 through the rocking contact 80. At the same time, the second arm 92 of the rocking contact 80 moves out of engagement with the ground terminal 54. The motor 11 is energized to move the window down.

The lever 20 can also be pivoted somewhat farther in the same direction to a second actuating position. The second actuating position of the lever 20 causes the first arm 90 of the rocking contact 80 to be deformed and applies an outwardly directed force to the contact pad 98. The contact pad 98 slides outward over the contact surface 52 on the B+ terminal 50, by the distance marked 120 in FIG. 5A. As this sliding movement occurs, the contact pad 98 and the contact surface 52 are "wiped" to clean them, as illustrated in FIGS. 5 and 5A.

It is preferred that this additional pivoting action takes place every time the rocker switch 14 is actuated. In one embodiment, for example, the lever 20 is pivoted about seven degrees to make electrical contact. An additional eleven degrees of pivotal movement results in the wiping action. This is the full range of movement of the lever 20.

When the manually applied force on the lever 20 is released, the parts of the switch assembly 10 return to the neutral condition shown in FIG. 3.

To move the window upward, the lever 20 is pivoted in a second direction opposite the first direction, that is, counterclockwise as viewed in FIG. 3. The second rocker switch 16 (FIG. 1) is actuated and the motor is operated in an opposite direction of rotation to move the window upward. The structure and operation of the second rocker switch 16 are similar to those of the first rocker switch 14 and therefore are not described.

Each one of the first and second arms 90 and 92 of the rocking contact 80 is selectively bendable to determine the pressure of the engagement between the arm and its associated terminal. Specifically, the first arm 90 includes a bendable portion 95 at the intersection between the inner portion 94 and the outer portion 96. If the outer portion 96 is bent farther downward from the inner portion 94, then the pressure of the first contact pad 98 on the B+ terminal 50 is increased. Conversely, if the outer portion 96 is bent farther upward from the inner portion 94, then the pressure of the first contact pad 98 on the B+ terminal 50 is decreased.

The sliding movement of the outer end surface 40 of the pin 36, along the first surface 112 on the moving contact assembly 70, provides a tactile feel to the person moving the lever 20. This tactile feel is controlled by the contour of the surfaces 40 and 112. The contour of either or both of these surfaces 40 and 112 can be changed to provide a different tactile feel. The contour of the first surface 112 on the plastic body portion 110 of the moving contact assembly 70 can be changed simply by molding the plastic body portion with a different contour. This change can be made without affecting the configuration or operation of the metal portion of the moving contact assembly 70, that is, the rocking contact 80. Thus, it is possible to provide a different tactile feel for different switches 10 of the present invention, simply by molding the plastic body portion 110 of the moving contact assembly 70 with a different contour.

The switch assembly 10 also includes two dome switches 130 and 132 (FIG. 2) for holding the motor 11 actuated in an automatic operation mode. The operation of these dome switches 130 and 132 is the same as the operation of the dome switches described in U.S. Pat. No. 5,598,918 and is not, therefore, described further herein.

From the above description of the invention, those skilled in the art will perceive improvements, changes and modifications in the invention. Such improvements, changes and modifications within the skill of the art are intended to be covered by the appended claims.

Having described the invention, I claim:

1. An electrical switch comprising:

first and second contacts spaced apart from each other;

a rocking contact having first and second arms in electrical contact with each other;

a support supporting said rocking contact for rocking movement in opposite first and second directions, said first arm moving into engagement with said first contact when said rocking contact rocks in said first direction and said second arm moving into engagement with said second contact when said rocking contact rocks in said second direction; and a lever which pivots to effect rocking movement of said rocking contact in said first and second directions, said lever pivoting in one direction a first distance to cause said first arm to engage said first contact and pivoting in said one direction a second distance beyond said first distance to cause said first arm to slide on said first contact.

2. An electrical switch as defined in claim 1 wherein said first and second arms extend outward from a central portion of said rocking contact, at least one of said arms having a bendable portion which is bendable to determine the pressure of the engagement between said one arm and said respective contacts.

3. An electrical switch as defined in claim 2 wherein said bendable portion of said at least one arm comprises first and second arm portions extending at an angle to each other, said angle determining the pressure of the engagement between said one arm and said respective contacts.

4. An electrical switch as defined in claim 2 further including a plastic body portion connected to said arms and having a first surface, said lever receiving a pin having an outer end surface engageable with and slidable along said first surface, said first surface and said outer end surface providing a tactile feel to the person moving said lever.

5. Apparatus as defined in claim 4, wherein said first surface has a concave contour and said outer end surface has a convex contour, said tactile feel being determined by said concave contour of said first surface and said convex contour of said outer end surface.

6. An electrical switch as defined in claim 4 wherein said first surface of said plastic body portion has a concave contour.

7. An electrical switch as defined in claim 4 wherein a portion of said rocking contact is exposed through said plastic body portion for establishing an electric circuit through said rocking contact.

8. An electrical switch as defined in claim 1 further including a plastic body portion connected to said arms and having a first surface, said lever receiving a pin having an outer end surface engageable with and slidable along said first surface of said plastic body portion, said first surface and said outer end surface providing a tactile feel to the person moving said lever.

9. Apparatus as defined in claim 8, wherein said first surface has a concave contour and said outer end surface has a convex contour, said tactile feel being determined by said concave contour of said first surface and said convex contour of said outer end surface.

10. An electrical switch as defined in claim 8 wherein said outer end surface of said pin has a convex contour and wherein said first surface has a concave contour for engaging said outer end surface of said pin.

11. An electrical switch comprising:

first and second contacts spaced apart from each other;

a rocking contact having first and second arms in electrical contact with each other and a plastic body portion molded to said arms and having a first surface;

a support supporting said rocking contact for pivotal movement in opposite directions, said first arm moving into engagement with said first contact when said rocking contact pivots in one direction and said second arm moving into engagement with said second contact when said rocking contact pivots in a second direction opposite said one direction; and a lever which pivots to effect pivotal movement of said rocking contact in said first and second directions, said lever receiving a pin having an outer end surface engageable with and slidable along said first surface, said first surface and said outer end surface providing a tactile feel to the person moving said lever.

12. An electrical switch as defined in claim 11 wherein said outer end surface of said lever has a convex contour and wherein said first surface has a concave contour for engaging said outer end surface of said lever.

13. An electrical switch as defined in claim 11 wherein a portion of said rocking contact is exposed through said plastic body portion for establishing an electric circuit through said rocking contact.

* * * * *